US005100069A

United States Patent [19]

Barclay

[11] Patent Number: 5,100,069

[45] Date of Patent: Mar. 31, 1992

[54] HUBLESS INTERLOCKING SHEARING MACHINE WITH SHALLOW GULLET DEPTHS

[76] Inventor: Randel L. Barclay, 5616 Carpenter Rd., Stockton, Calif. 95205

[21] Appl. No.: 573,403

[22] Filed: Aug. 27, 1990

[51] Int. Cl.[5] ..... B02C 7/04

[52] U.S. Cl. ..... 241/236; 241/295; 241/DIG. 31

[58] Field of Search ..... 241/236, DIG. 31, 293, 241/294, 295

[56] References Cited

U.S. PATENT DOCUMENTS

| | | | |
|---|---|---|---|
| 3,931,935 | 1/1976 | Holman | 241/24 |
| 3,951,935 | 1/1976 | Holman | 241/236 X |
| 3,991,944 | 11/1976 | Baikoff | 241/36 |
| 4,241,882 | 12/1980 | Baikoff | 241/236 |
| 4,374,573 | 2/1983 | Rouse et al. | 241/101.7 |
| 4,560,112 | 12/1985 | Rouse et al. | 241/236 |
| 4,607,800 | 8/1986 | Barclay | 241/159 |
| 4,625,925 | 12/1986 | Goldhammer | 241/236 |
| 4,684,071 | 8/1987 | Dicky | 241/236 X |
| 4,860,963 | 8/1989 | Goldhammer et al. | 241/236 |
| 4,901,929 | 2/1990 | Barclay | 241/236 |

FOREIGN PATENT DOCUMENTS

| | | | |
|---|---|---|---|
| 102453 | 6/1984 | Japan | 241/236 |
| 2201905 | 9/1988 | United Kingdom | 241/236 |

*Primary Examiner*—Mark Rosenbaum
*Assistant Examiner*—Frances Chin
*Attorney, Agent, or Firm*—Schneck and McHugh

[57] ABSTRACT

A secondary waste apparatus for shearing waste material such as a discarded vehicle tire which has already been reduced in size by a primary shearing process. The apparatus includes a pair of counter-rotating shafts, each shaft having a plurality of generally annular shear members extending in a unitary construction from an abutting relationship with the shaft to an outside diameter which meshes with the shear members of the other shaft. The ratio of the diameter of each shaft to the maximum radial extent of the shear members abutting the shaft being greater than 3:5. Adjacent shear members on a shaft are spaced apart by a driving spacer and one or more grind-depreciable shims. Waste material from a primary shearing process is fed into the apparatus to further reduce the maximum size of the material. The apparatus is periodically sharpened by grinding of the shear members and the shims.

5 Claims, 3 Drawing Sheets

HUBLESS INTERLOCKING SHEARING MACHINE WITH SHALLOW GULLET DEPTHS

DESCRIPTION

1. Technical Field

The present invention relates generally to apparatus for conversion of solid waste materials into small pieces and more particularly to a secondary shearing machine for further reducing waste received from a first shearing process.

2. Background Art

The problem of disposing of bulky waste materials is receiving increasing attention as existing landfills reach capacity and the availability of additional land for waste disposal decreases. Reducing waste, such as tires, in size permits volume densification and reduces the requirements of subsequent processing.

Machines which utilize paired shearing wheels to shred waste material into smaller pieces have been developed. For example, U.S. Pat. Nos. 4,901,929 and 4,607,800 to Barclay disclose machines in which counter-rotating shearing wheels overlap at the edges of the shearing wheels to cut into the waste material like giant knives. Other patents teaching this type of machine include U.S. Pat. No. 4,374,573 to Rouse et al. and U.S. Pat. No. 3,931,935 to Holman. The Barclay, Rouse et al. and Holman machines are "primary" shredders in the sense that whole tires may be fed into the machines for shredding. As best seen in the above-cited U.S. Pat. No. 4,901,929 to Barclay, annular hubs are attached to the outside diameter of drive shafts and the shearing wheels are fixed to the hubs.

A second type of primary shredding machine is described in U.S. Pat. Nos. 3,991,944 and 4,241,882 to Baikoff. The Baikoff patents teach comminuting machines having counter-rotating shafts with comminutor rings. The rings include cutter-noses which come in close proximity to the outer diameter of the opposite shaft to which the rings are attached so as to provide the cutting action. The patents teach that the outer surfaces of the counter-rotating shafts act as anvils for the cutting action of the cutter-noses of the rings. The rings are attached to annular shaft-collars which extend from the outside diameter of the shafts. Thus, the shaft-collars are the functional equivalents of the shaft hubs of the other patents cited above.

While the primary waste-reducing machines of the prior art significantly reduce the size of tires and the like, in some applications it is desirable to provide further reduction. One method is to first freeze and then jolt the material. However, this can be an expensive method.

It is an object of the present invention to provide a secondary shearing machine which has a fine pitch of shearing members and which allows a greater number of shears without rendering the machine more susceptible to breakage resulting from the increased torque necessary to achieve the increase in shears.

SUMMARY OF THE INVENTION

The above object has been met by a shearing machine having annular shear members which, rather than being attached to hubs or shaft-collars which are used to expand the outside diameter of a shaft at the shearing members, have inside diameters which directly contact the outside diameters of shafts that support the shearing members. That is, the shearing members are not held away from the shafts by hubs. This allows the shafts of the secondary waste apparatus to have a larger diameter and, since a larger diameter shaft is better able to withstand an increase in torque, a more powerful drive may be utilized. Moreover, the larger diameter shafts are better structurally-suited for resistance to deflection of the shear members.

The apparatus includes first and second shafts, drawing power from a drive which causes counter-rotational motion of the shafts. A first set of generally circular shear members extend in unitary construction from the outside diameter of the first shaft to a maximum radial extent which is generally circular. Likewise, a second set of shear members is fixed to the second shaft. The inside diameter of the second set of shear members abuts the outside diameter of the second shaft. The ratio of the diameter of a shaft to the maximum radial extent of the shear members attached to the shaft exceeds 3:5. In a preferred embodiment, the ratio exceeds 4:5.

The counter-rotating shafts are spaced apart by a distance less than the maximum radial extent of the shear members. The shear members on each shaft are spaced apart from adjacent shear members on the same shaft by a distance slightly greater than the thickness of the shear members. Thus, the first set of shear members are in meshing relation with the second set of shear members. The overlapping of edges define shear regions.

The adjacent shear members on a shaft are spaced apart by a driving spacer and at least one depreciable-width shim. Shear members must be periodically sharpened by grinding of the opposed edges of the shear members. To maintain proper distances of the shear members of a first shaft from the shear members of a second shaft, the width of the depreciable shims of the second shaft must be ground to correspond to grinding of shear members on the first shaft. The width of a shear member should be slightly less than the total width of the shims and the driving spacer opposite to the shear member.

The outside diameter of the shear members is spaced apart from the outside diameter of the opposite, counter-rotating shaft. The distance from a shear member to a counter-rotating shaft is defined as a gullet depth. The gullet depth of the secondary waste apparatus is insufficient for shearing of a whole tire. In use, the waste material from a primary shearing process is fed between the counter-rotating shafts. The apparatus provides a second shear for further reducing the maximum size of the waste material.

An advantage of the present invention is that the hubless construction allows use of larger diameter shafts. The larger diameter shafts are able to withstand a greater torque. Consequently, a greater horsepower drive can be utilized. The increase in horsepower is required for use of shear members having a fine pitch. This is because the fine pitch increases the number of shears per square inch. The present apparatus allows shredding of waste material at a faster pace and with a finer end product. Another advantage is that the construction of the present invention facilitates maintenance of the shear member.

BEST MODE FOR CARRYING OUT THE INVENTION

Figure 1:
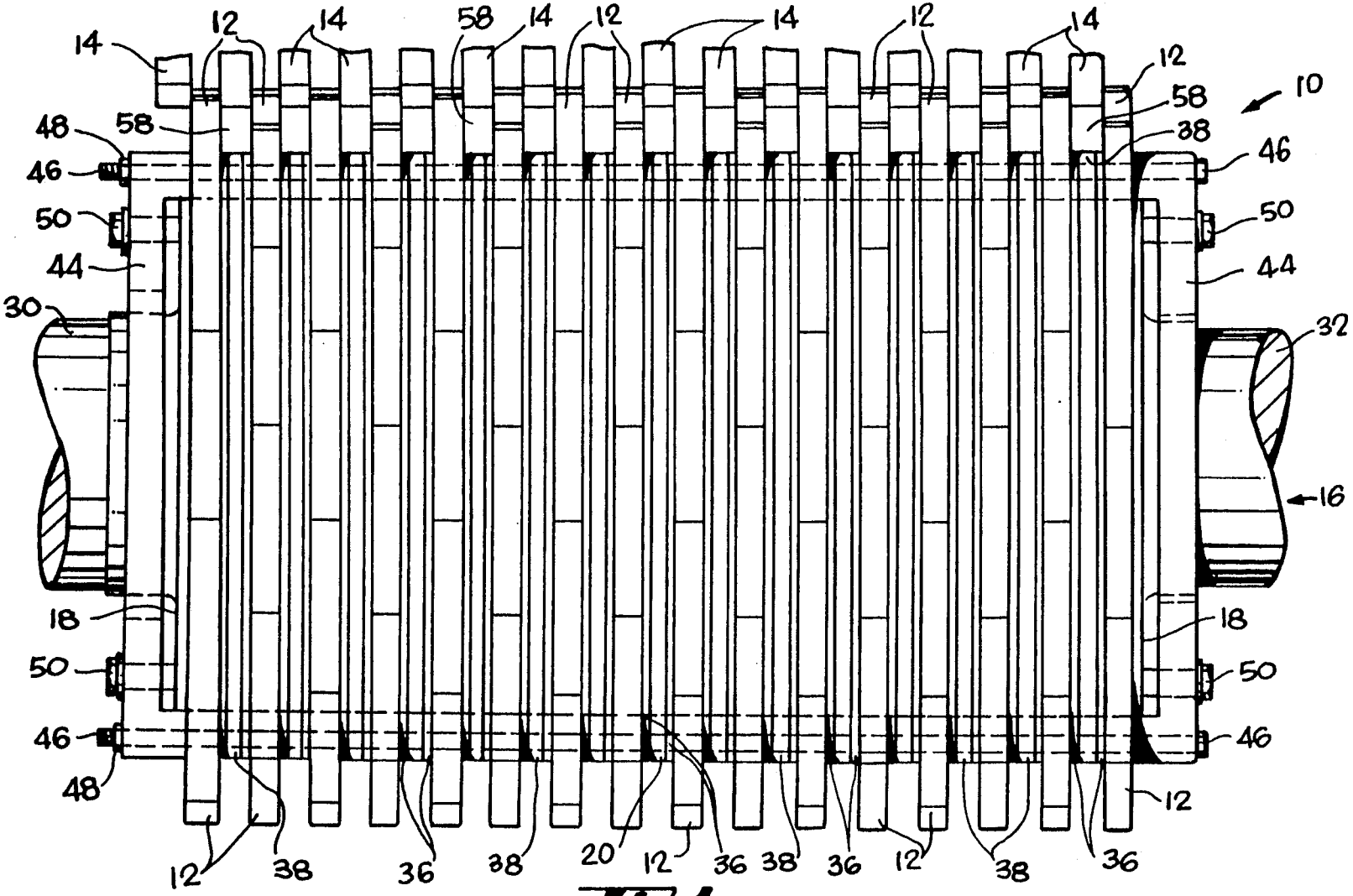
FIG. 1 is a top view of a rotary shear having shear members in meshing relation with other rotary shears, in accord with the present invention.

With reference to FIG. 1, a rotary shear 10 of the present invention includes sixteen shear members 12. The shear members 12 are spaced apart from each other by a distance to allow meshing with a second set of sixteen shear members 14. The first set of shear members 12 is caused to rotate in a direction opposite to rotation of the second set of shear members 14 for the reduction of waste material into smaller pieces. The operation of the counter-rotating members 12 and 14 is described more fully in U.S. Pat. No. 4,901,929 to Barclay, which is incorporated herein by reference.

Figure 2:
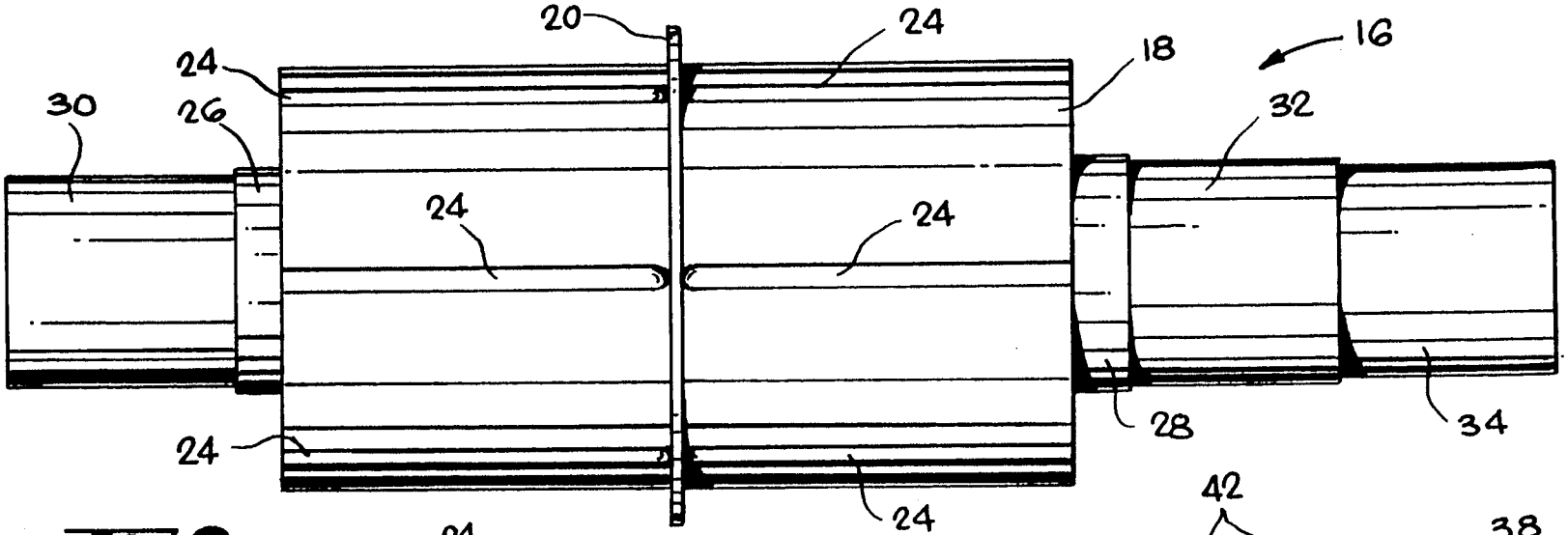
FIG. 2 is a front view of the shaft of FIG. 1.

Unlike the shredding machines of the prior art, the secondary shear apparatus 10 does not include hubs for mounting the shear members 12 and 14 to counter-rotating shafts FIG. 2 illustrates a shaft 16 for mounting of the shear members. The mounting region 18 of the shaft is a large diameter region. Because the outer diameter is further removed from the axis of the shaft than is typical of shredding devices, the present invention is better able to withstand an increase in power for driving the shaft and the shear members fixed to the shaft. An increase in power is required to drive the secondary waste apparatus having a greater number of cuts than a standard shear machine.

The mounting region 18 of the shaft 16 includes a center registration ring 20. The registration ring must be fixed relative to the shaft so that the axis of the registration ring is coincident with the axis of the shaft. Preferably, the registration ring is an integral part of the shaft.

Figure 3:
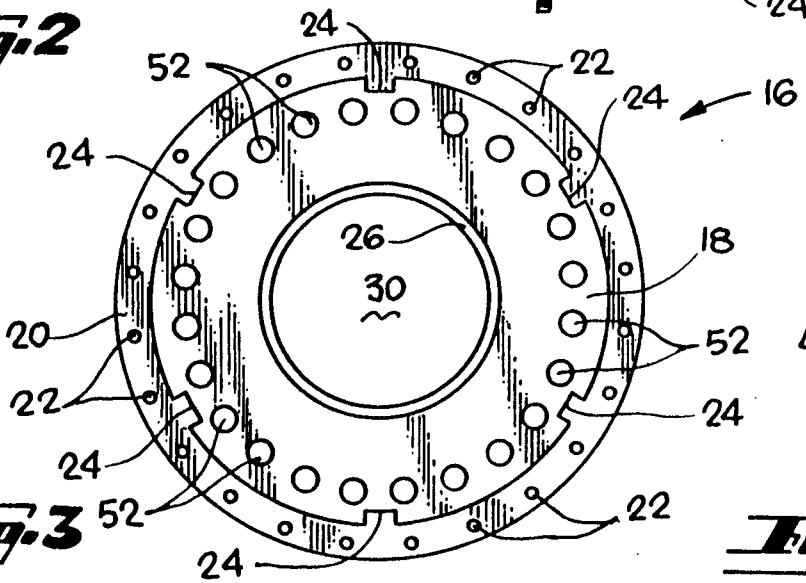
FIG. 3 is an end view of the shaft of FIG. 2.

Referring now to FIGS. 2 and 3, the registration ring 20 has a diameter greater than the mounting region 18 of the shaft 16. An array of bores 22 are equidistantly spaced about the registration ring parallel to the axis. The mounting region 18 of the shaft includes six equidistantly spaced key slots 24. Adjacent each end of the mounting region 18 is an end cap stop 26 and 28. The end cap stops are shaft regions which are reduced in diameter.

On the side of the end cap stops 26 and 28 opposite to the mounting region 18 is a shaft bearing region 30 and 32. Typically, the shaft 16 is rotatably mounted to a support structure, not shown, by frictionless bearing assemblies. The frictionless bearing assemblies contact the circumference of each shaft bearing region 30 and 32. Finally, at one end of the shaft is a sprocket-mount region 34. This region is coupled to a drive motor for rotating the shaft.

Referring to FIG. 1, the registration ring 20 is shown as being at the center of the sixteen shear members 12 of shaft 16. The registration ring acts as a stationary right-angle register for the shear members. That is, the registration ring squares two groupings of eight shear members. During operation the registration ring prevents skewing of the shear members.

The shear members 12 may have a width of one inch. In such case, the distance between adjacent shear members 12 should be slightly greater than one inch so that the counter-rotating shear members 14 can be brought into meshing relationship. Here, the registration ring 20 has a width slightly greater than one-half of the width of the shear members 12. For example, where the width of the shear members is one inch, the width of the registration ring should be 0.505 inch. On each side of the registration ring is a grind-depreciable shim member 36. The shear members 12 and the shims 36 are made of a material which allows periodic grinding. For example, the shear members and the shims may be made of a mild steel which is case carbonized. The grinding of the shims is performed periodically in conjunction with the sharpening of the shear members as shear members wear from usage. Sharpening will be described more fully below. With the exception of the shear members 12 on the opposite sides of the registration ring, between adjacent shear members are two grind-depreciable shims 36 which sandwich a driving spacer 38. Preferably, the driving spacers 38 have a width equal to the width of the registration ring 20. Thus, where the shear members have a width of one inch, the driving spacers have a width of 0.505 inch and each shim 36 has a width of 0.25 inch. Alternatively, the pair of shims 36 may be replaced by a single shim of 0.5 inch.

Figure 4:
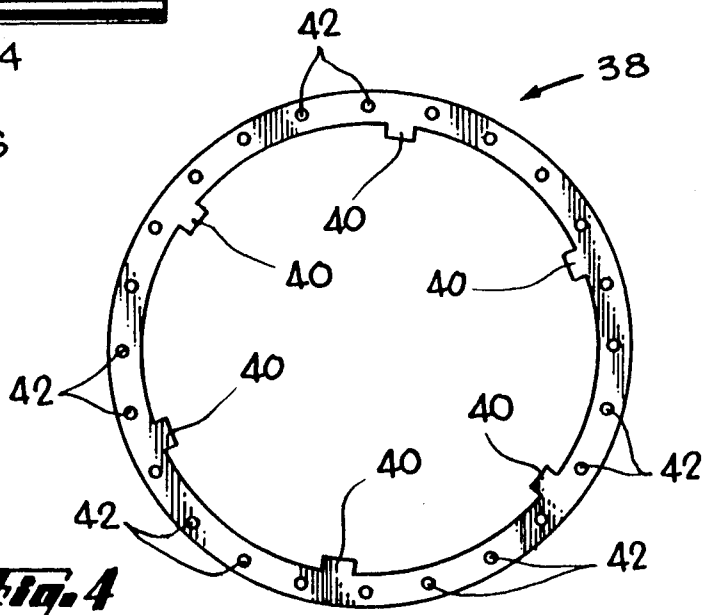
FIG. 4 is an end view of a driving spacer of FIG. 1.

A driving spacer 38 is shown in FIG. 4. The driving spacer includes six equidistantly spaced keys 40 which are received within the key slots 24 of the shaft of FIG. 3. After insertion of the keys 40 within the slots 24, the driving spacer 38 is forced to rotate with the shaft 16. An array of holes 42 about the driving spacer matches the array of bores 22 in the registration ring 20 of the shaft.

In constructing the secondary waste apparatus 10 of FIG. 1, the shear members 12, the driving spacers 38 and the grind-depreciable shims 36 are sequentially positioned on one side of the registration ring. An end cap 44 is utilized to provide a force which compresses eight shear members 12, the shims 36 and the driving spacers 38. In an identical fashion, the eight shear members on the opposite side of the registration ring are installed and an end cap 44 provides a compression force for ensuring that the shear members remain in alignment with each other and with the second set of shear members 14.

As noted above, the driving spacers 38 are keyed to the mounting region 18 of the shaft 16 for rotation therewith. Rotational motion is translated to the shear members 12 by a ring of bolts 46 which are secured in place by nuts 48. The bolts 46 pass through the array of bores 22 of the registration ring 20 shown in FIG. 3 and pas through the corresponding array of holes 42 of the driving spacer 38 of FIG. 4. A second series of bolts 50 are threaded into the planar end of the mounting region 18 of the shaft to secure each end cap. As shown in FIG. 3, the ends of the mounting region 18 of the shaft include internally-threaded holes 52 to receive the bolts which fasten the end caps to the shaft.

Figure 5:
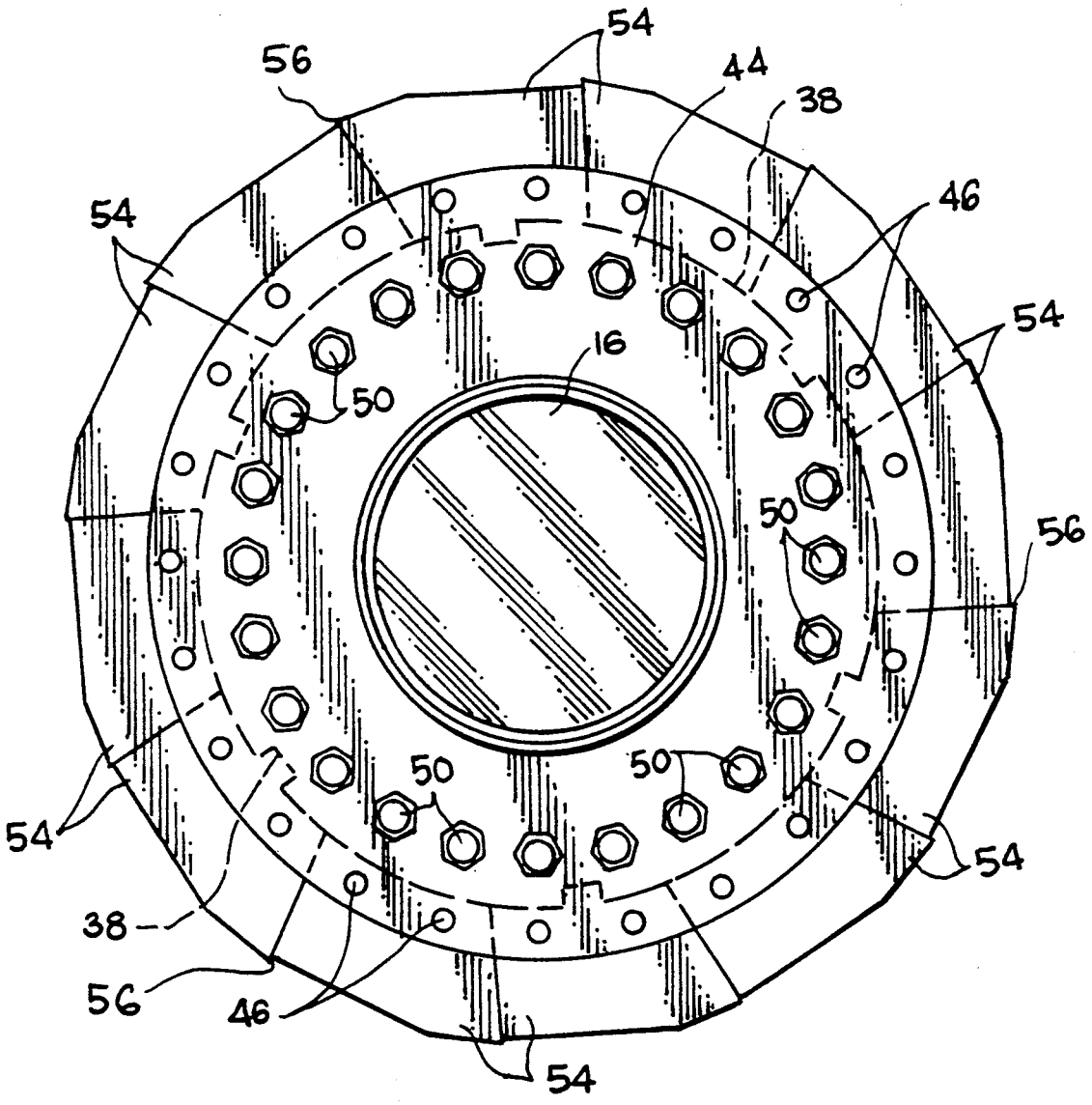
FIG. 5 is an end view of the shear of FIG. 1.

Referring now to FIG. 5, the shear members may be unitary members, but preferably comprise a number of knife segments 54. The knife segments are coupled to a driving ring 38, shown in phantom, by the bolts 46. Preferably, the grind-depreciable shim 36 described above is sandwiched between the knife segments 54 and the driving spacer 38. The shim may be segmented in the same manner as the shear member. The knife segments are mounted so that the radially inward surface of each contacts the mounting region of the shaft 15. The lead edge of each knife segment 54 extends radially outward beyond the extent of the trail edge of an adjacent knife segment to form a tooth 56. The knife segments are each constructed of a hardened, wear-resistant material suitable for cutting into discarded tires, appliances and the like. For example, a high grade tool steel may be used.

In a preferred embodiment, the knife segment 54 has a width of one inch. The driving spacers 38 extend 1.5 inches beyond the outside diameter of the mounting region of the shaft, with the knife segments extending an additional 1.75 inches. The maximum radial extent of the apparatus is 24.25 inches. The ratio of the outside diameter of the mounting region of the shaft to the maximum radial extent of the shear members should exceed 3:5 in order to achieve the necessary mechanical strength. Preferably, the ratio exceeds 4:5. The high ratio of outside diameter of the shaft to the outside diameter of the shim members is possible because, unlike the prior art, the shear members abut the circumference of the shaft.

In operation, at least two counter-rotating shearing wheels are required in the secondary waste apparatus. FIG. 1 illustrates one wheel and includes the end of the shear members 14 of a second shearing wheel. The shearing members 12 of the first wheel overlap with the shearing members 14 of the other wheel. Here, the wheel should be spaced apart by a distance of 24 inches. While not illustrated, there is a small gap between adjacent shear members 12 and 14. The size of the gap is important. Excessive clearance causes the shear members to tear rather than to cut the waste material while too close of a spacing causes premature wear of the shear members. Preferably, the axial clearance should be 0.002 inch and should not exceed 0.03 inch.

Due to the arduous nature of shearing waste material, the edges of the shear members 12 and 14 wear with use. However, the members are made up of material which allows resharpening. When wear is excessive, the members can be removed and a grinding process can then be employed to return the shear members to a condition in which the opposed faces are planar.

The sharpening of the opposed sides of the shear members by a process of grinding material affects the axial clearance between adjacent shear members 12 and 14. For this reason, the grind-depreciable shims 36 are included in the present invention. If, for example, the shear member 14 is ground to remove 0.015 inch from each side of the shear member, the shims can be ground to remove a total of 0.030 inch. The material can be removed from either of the two shims 36 which aid in providing clearance for the sharpened shear member 14 or one-half of the total of 0.030 inch can be removed from each shim. Optionally, as noted above, the two shims 36 between adjacent shear members 12 can be replaced by a single shim of twice the width.

After grinding has depreciated the width of the shear members 12 and the depreciable shims 36, the wheel is again assembled and end caps 44 provide the compression force for maintaining the assembly square with respect to the axis of the shaft 16. The end caps 44 are circular members having a hollow interior, allowing the end caps to slide about the mounting region of the shaft 16. Thus, depreciation of members 12 and shims 36 can be accommodated by threading the bolts 50 into the shaft 16 to a greater extent than prior to depreciation. However, after repeated sharpening of the members 12 and shims 36, the end caps 44 will come to abut the mounting region 18 of the shaft. At this time, the operator can replace each of the shear members 12 and the shims 36. However, preferably a seventeenth and eighteenth shear member is added to the assembly so that the compression caps are again removed from the opposed ends of the mounting region 18. This addition of shear members and shims can be performed on a recurring basis.

The space between a shear member 14 and a driving spacer 38 defines a gullet depth 58. The gullet depth of the secondary waste apparatus is significantly smaller than that of a primary machine. The primary machine must have a gullet depth sufficiently large to accommodate thick pieces of material as a whole tire is sheared. The secondary waste apparatus of the present invention, on the other hand, receives waste material of a known size. The gullet depth of the present invention is also less than the depth which would be possible if the shear members were mounted to a hub, as is typical in the art. The gullet depth should be less than four inches. Here, the gullet depth is less than two inches.

The distance between shear members 12 on a shaft 16 and the gullet depth determine the size of waste material exiting from the apparatus 10. The pitch of the shear member should be in the range of 0.25 inch to 1.5 inches. The present invention has the potential of cutting scrap tires into squares of less than 1 inch by 1 inch.

The secondary shear apparatus 10 also includes ploughs, not shown, which are employed to remove shredded material trapped between adjacent shear member 12 during operation of the apparatus. The plough may include a plurality of stationary fingers, with each stationary finger being inclined to project into a gullet to strip shredded material from within the gullet. Alternatively, each of the counter-rotating shafts may be operatively associated with a rotary plough which reaches into the spacing between the shear members 12 on the shaft to strip away shredded material. The rotary plough is driven to rotate in a direction opposite to that of the shaft.

While the driving spacers 38 are illustrated in FIG. 4 as unitary members, the driving spacers may be segmented. However, each segment must include at least two keys 40 to ensure that the driving spacers are not separated from the shaft by high torque rotation of the apparatus.

I claim:

1. A rotary shear apparatus having shear members requiring periodic sharpening by material removal comprising, a first rotatable shaft having a set of spaced apart first shear members and a plurality of first driving spacers, said first driving spacers disposed between adjacent first shear members, said first shear members being segmented, a second rotatable shaft extending parallel to said first shaft and having a set of spaced apart second shear members and a plurality of second driving spacers disposed between adjacent second shear members, said second shear members being segmented said first shear members in meshing relation with said second shear members to define shear regions along overlapping edges of said first and second shear members, and a plurality of shim means disposed between adjacent first shear members and between adjacent second shear members for selectively varying the distance between said adjacent shear members upon sharpening of said shear members, said driving spacers mounted to said shafts, said shear members mounted so as to be driven by said driving spacers, whereby said shim means of one of said first and second shafts is reduced in correspondence with material removal upon said sharpening.

2. The shear apparatus of claim 1 wherein said first and second shear members are each a generally annular member, the inner diameter of said annular member abutting one of said first and second shafts.

3. The shear apparatus of claim 1 wherein said driving spacers are mounted at the outside diameters of said first and second shafts by keys said shear members being bolted to said driving spacers.

4. The shear apparatus of claim 1 wherein said shim means is a plurality of depreciable-width shims disposed between said driving spacers and said shear members, said shims being bolted to said driving spacers.

5. The shear apparatus of claim 1 wherein each of said shear members and said shim means is a segmented generally annular member.

* * * * *